US005763816A

United States Patent [19]

Keeling

[11] Patent Number: 5,763,816

[45] Date of Patent: Jun. 9, 1998

[54] EXPLOSIVE PRIMER

[75] Inventor: Paul Scott Keeling, Edmond, Okla.

[73] Assignee: Slurry Explosive Corporation, Oklahoma City, Okla.

[21] Appl. No.: 687,861

[22] Filed: Jul. 26, 1996

[51] Int. Cl.[6] ..... F42B 3/00; F42B 7/00; C06C 5/06

[52] U.S. Cl. ..... 102/322; 102/331; 102/275.11; 102/332; 102/282; 102/275.12

[58] Field of Search ..... 102/275.5, 275.6, 102/275.7, 275.11, 275.12, 331, 332, 322, 282, 530, 531

[56] References Cited

U.S. PATENT DOCUMENTS

| | | | |
|---|---|---|---|
| 94,847 | 9/1869 | Shaffner | 102/282 |
| 1,329,503 | 2/1920 | Casey | 102/282 |
| 1,469,442 | 10/1923 | Messer | 102/322 |
| 1,512,714 | 10/1924 | Saucier | 102/322 |
| 3,415,192 | 12/1968 | Stadler et al. | 102/322 |
| 3,464,355 | 9/1969 | Aclin et al. | 102/530 |
| 3,831,522 | 8/1974 | Romney | 102/331 |
| 3,955,504 | 5/1976 | Romney | 102/331 |
| 4,023,494 | 5/1977 | Barton et al. | 102/24 R |

(List continued on next page.)

FOREIGN PATENT DOCUMENTS

| | | | |
|---|---|---|---|
| 5482 | 12/1882 | United Kingdom | 102/322 |

OTHER PUBLICATIONS

Product Brochure on Titan® G Booster by DYNO Nobel, Inc., published prior to Jul., 1995, Date Unknown.

Product Brochure on Dynoprime™ Cast Booster, by ireco DYNO Explosives Group, Salt Lake City, Utah, published prior to Jul., 1995, Date Unknown.

Product Brochure on Hi–Prime® Ammonia Gelatin Dynamite Booster by ICI ExplosivesUSA, Inc., 15301 Dallas Parkway, Dallas, Texas 75248–4629, published prior to Jul., 1995, Date Unknown.

Product Brochure on Trojan Corporation Super Prime® Standard Booster by Trojan Corporation, P.O. Box 310, Spanish Fork, Utah 84660, published prior to Jul., 1995, Date Unknown.

*Primary Examiner*—Charles T. Jordan
*Assistant Examiner*—Theresa M. Wesson
*Attorney, Agent, or Firm*—Mary M. Lee

[57] ABSTRACT

An explosive primer designed for use with a fuse cord and an initiating device. The primer consists of a container, which holds the explosive, and a cap received on the open end of the container. The container has two lateral opposing cord tunnels which run the length of the container. The cord tunnels protect the fuse cord on the inside of the primer. The cap has two apertures which align with cord tunnels in the container. The cap has capwell for receiving the detonator. The capwell is pierceable so that a detonator can be inserted through the capwell and embedded directly in the explosive composition inside the container. In addition, the primer contains grooves in the bottom of the container and in the cap. The grooves communicate with the apertures and the recess in the cap and the cord tunnels to create a continuous conduit so that a fuse cord can be threaded therethrough to secure the cord to the primer and selectively position the primer in a borehole at the blast site.

46 Claims, 3 Drawing Sheets

U.S. PATENT DOCUMENTS

| | | | |
|---|---|---|---|
| 4,060,033 | 11/1977 | Postupack et al. | 102/24 R |
| 4,098,189 | 7/1978 | Holm | 102/322 |
| 4,141,296 | 2/1979 | Calder, Jr. et al. | 102/332 |
| 4,178,852 | 12/1979 | Smith et al. | 102/24 R |
| 4,226,184 | 10/1980 | Ljungberg | 102/322 |
| 4,334,476 | 6/1982 | Day et al. | 102/275.7 |
| 4,350,097 | 9/1982 | Bowman et al. | 102/322 |
| 4,370,930 | 2/1983 | Strasser et al. | 102/322 |
| 4,383,484 | 5/1983 | Morrey | 102/275.3 |
| 4,425,849 | 1/1984 | Jorgenson | 102/275.12 |
| 4,485,741 | 12/1984 | Moore et al. | 102/331 |
| 4,495,867 | 1/1985 | Mitchell, Jr. et al. | 102/275.4 |
| 4,637,312 | 1/1987 | Adams et al. | 102/275.12 |
| 4,765,246 | 8/1988 | Carlsson et al. | 102/275.12 |
| 4,796,533 | 1/1989 | Yunan | 102/275.12 |
| 4,872,408 | 10/1989 | Marz | 102/282 |
| 4,879,952 | 11/1989 | Dowing et al. | 102/331 |
| 4,938,143 | 7/1990 | Thomas et al. | 102/332 |
| 4,949,649 | 8/1990 | Reinelt | 102/282 |
| 5,392,712 | 2/1995 | Waldock | 102/275.12 |
| 5,435,250 | 7/1995 | Pollock | 102/317 |
| 5,454,323 | 10/1995 | Conil | 102/282 |
| 5,515,784 | 5/1996 | Peebles | 102/275.7 |

EXPLOSIVE PRIMER

FIELD OF THE INVENTION

The present invention relates generally to containers for use with explosive compositions and, more particularly, to explosive primers.

SUMMARY OF THE INVENTION

The present invention is directed to a container for containing an explosive composition and for use with an initiating device. The container comprises an enclosure for the explosive composition. The enclosure includes a port. The port forms a base adapted to be pierced by the application of gentle pressure whereby the initiating device is insertable into the explosive composition inside the enclosure. The base comprises a center portion surrounded by a thin membrane adapted to yield to gentle pressure.

The present invention further is directed to an explosive primer for use with an initiating device. The primer comprises an explosive composition and an enclosure for the explosive composition. The enclosure includes a port. The port forms a base adapted to be pierced by the application of gentle pressure whereby the initiating device is insertable into the explosive composition inside the enclosure. The base comprises a center portion surrounded by a thin membrane adapted to yield to gentle pressure.

The present invention further is directed to a container for containing an explosive composition and for use with a fuse. The container comprises an enclosure for the explosive composition. The enclosure includes a first end and a second end and forms at least two lateral opposing conduits adapted to receive the fuse. The longitudinal axes of the opposing conduits are generally parallel to the longitudinal axis of the enclosure. A lower transverse conduit is formed in the second end of the enclosure. The lower transverse conduit is adapted to receive the fuse and communicates with the lateral opposing conduits. An upper transverse conduit is formed in the first end. The upper transverse conduit is adapted to receive the fuse and communicates with the lateral opposing conduits.

The present invention is directed to an explosive primer for use with an initiating device. The primer comprises an explosive composition and an enclosure for the explosive composition. The enclosure includes a first end and a second end and forms at least two lateral opposing conduits adapted to receive the fuse. The longitudinal axes of the opposing conduits are generally parallel to the longitudinal axis of the enclosure. A lower transverse conduit is formed in the second end of the enclosure. The lower transverse conduit is adapted to receive the fuse and communicates with the lateral opposing conduits. An upper transverse conduit is formed in the first end. The upper transverse conduit is adapted to receive the fuse and communicates with the lateral opposing conduits.

The present invention further is directed to a container for containing an explosive composition and for use with an initiating device. The container comprises an enclosure for the explosive composition. The enclosure includes a port. The port forms a base adapted to be pierced by the application of gentle pressure whereby the initiating device is insertable into the explosive composition inside the enclosure. The base defines at least one score adapted to permit the based to be pierced by the application of gentle pressure.

Finally, the present invention is directed to an explosive primer for use with an initiating device. The explosive primer comprises an explosive composition and an enclosure for the explosive composition. The enclosure includes a port. The port forms a base adapted to be pierced by the application of gentle pressure whereby the initiating device is insertable into the explosive composition inside the enclosure. The base defines at least one score adapted to permit the based to be pierced by the application of gentle pressure.

DETAILED DESCRIPTION OF THE PREFERRED EMBODIMENT

Figure 1:
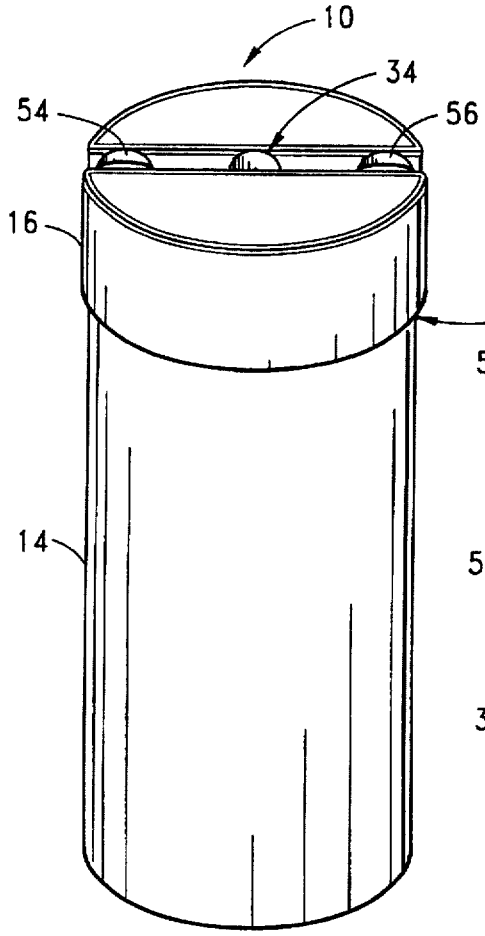
FIG. 1 is a perspective view of the assembled primer of the present invention.

Use of an explosive primer with low-sensitivity explosives, such as affordable ammonium nitrate fuel oil mixtures (ANFO), optimizes blasting performance while minimizing cost. The primer consists of a cartridge containing a dynamite or other highly sensitive explosive detonable by a blasting cap or other initiating device. The initiating device is connected to the primer. The primer is then suspended in a borehole loaded with ANFO or other low-sensitivity blasting agent. The primer accepts initiation from the initiating device and transmits it to the main charge.

A variety of methods may be used to connect the detonator to the primer, depending upon the type of primer used. One method requires punching a hole in the end or side of the primer with a powder punch and inserting the detonator through the container into direct contact with the explosive. The hole should be somewhat longer than the length of the detonator to ensure that the detonator makes contact with the explosive composition inside the primer. The fuse cord is then taped or tied to the outside of the primer. Problems arise in that the detonator may not be properly positioned within the primer resulting in only partial detonation of the primer and therefore less efficient burning of the main charge.

Alternatively, cast primers comprise a capwell for receiving a detonator to initiate the charge. The detonator is placed in the capwell and the fuse cord secured to the primer. Failure to completely position the detonator inside the capwell will result in failed or inadequate blasting performance.

With both of these methods, care must be exercised to properly position the detonator within the primer to ensure the most efficient, effective and the safest blasting of the main charge. Failure to properly position the detonator in the primer may result in partial detonation or in the detonator shooting through the side of the cartridge without exploding. Another difficulty arises when securing the fuse cord on the outside of the primer. Cords and leg wires tied or taped to the outside of the primer cartridge can become loose resulting in damaged cords and ineffective loading of the primer within the main charge.

The primer of the present invention provides a pierceable port through which a detonator may be placed in direct contact with an explosive gel inside the container. The pierceable port aids in properly positioning the detonator near the center of the primer to enhance performance, thus minimizing the chance that the detonator will partially fire or will shoot out the side of the primer. The primer of the present invention also provides opposing longitudinal conduits for threading the fuse cord on the inside of the primer and securing the fuse cord to the primer. Additionally, the ends of the primer form grooves communicating with the conduits to receive and protect the fuse cord on the outside of the primer. The conduits and the grooves in tandem secure the fuse cord to the primer without tying or taping, permit selective positioning of the primer in the borehole and minimize damage to the fuse cord. Additionally, the primer of the present invention is water resistant to perform in high water pressures or after extended delays at the blast site.

Figure 2:
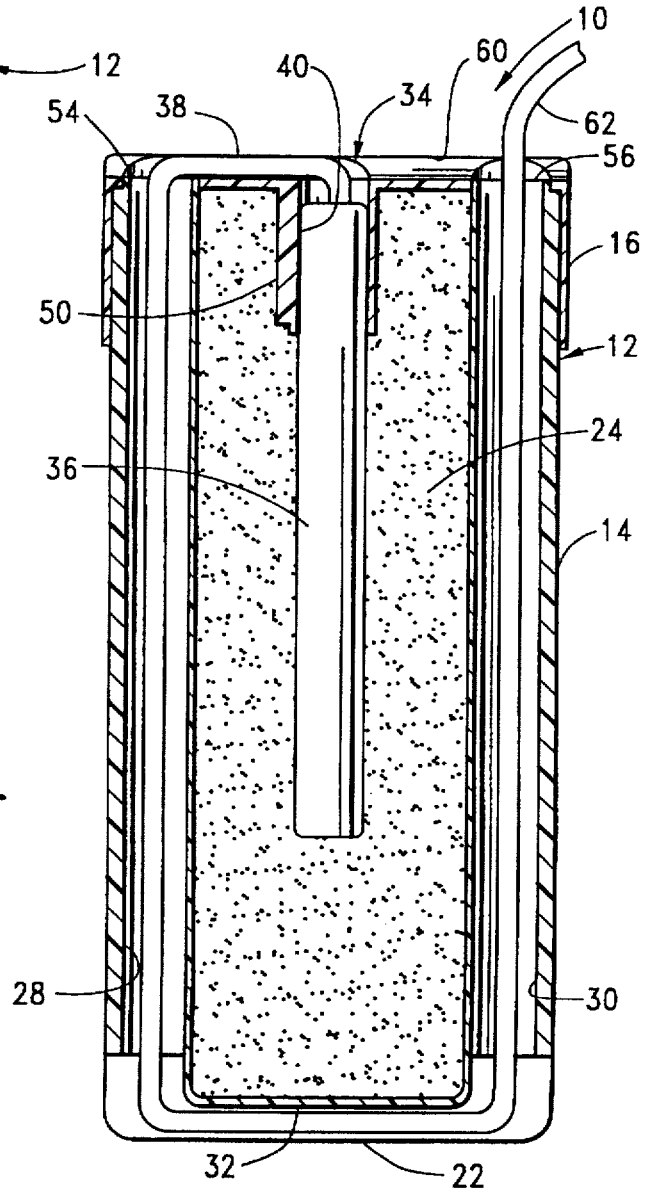
FIG. 2 is a longitudinal cross-sectional view of the assembled primer of the present invention with the initiating device and fuse installed.

Turning now to the drawings in general and to FIGS. 1 and 2 in particular, there is shown therein a primer constructed in accordance with the present invention and designated generally by the reference numeral 10. The primer comprises a container 12 including a body 14 and a cap 16.

The body 14 of the container 12 preferably is cast by injection molding into a one-piece integrally-formed unit. A cylindrical body 14 is preferred to facilitate placement of the primer 10 in the desired position in the borehole. Additionally, a cylindrical body 14 is easier to pack and ship and to handle at the blast site.

The body 14 may be formed of any suitable material. Plastic is a preferred material due to its affordability and ease of manufacture and use. A preferred plastic is high density polyethylene since this material is weather resistant, firm and durable and operates under extreme temperatures without becoming brittle or cracking. Nylons and polypropylenes are acceptable plastic alternatives. A metal, such as aluminum, provides an acceptable albeit costly alternative to plastic.

Figure 3:
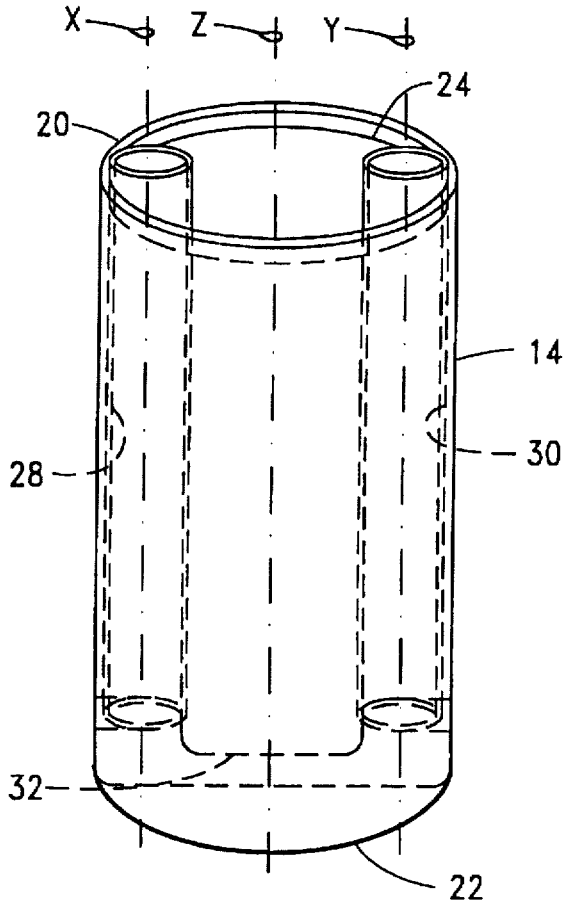
FIG. 3 is a perspective view of the body of the container of FIG. 1 and shows in phantom the generally parallel configuration of the lateral opposing conduits.

The body 14 preferably further comprises an open end 20, illustrated in FIG. 3, and a closed end 22. The body 14 is filled with an explosive composition 24 through the open end 20.

The body is adaptable to contain any type of explosive, whether wet, dry, mixtures or molecular explosives. In particular, the body 14 is suited to hold blasting gelatins and other high velocity explosives, due to its integral construction and water-impervious plastic composition. However, any highly sensitive explosive is an acceptable alternative. In the preferred embodiment, the explosive composition 24 is poured into the body 14 through the open end 20 in a semiliquid or slurried form. The amount of explosive composition 24 in the primer varies depending upon the size of the primer and its purpose, but generally ranges in weight from approximately one-third to two pounds. Moreover, the volume of explosive composition 24 in the body 14 should approximate the volume of the body for a purpose yet to be described. Gellants and cross-linking agents in the explosive composition 24 cause the slurry to gel inside the body 14 to the desired consistency.

With reference to FIGS. 2 and 3, the body 14 further comprises opposing conduits 28 and 30. Opposing conduits 28 and 30 are laterally opposed and preferably are integrally formed with the inside wall of the body 14. Alternatively, opposing conduits 28 and 30 may comprise longitudinal grooves continuous with the exterior of the body 14. As shown in FIG. 3, the longitudinal axes X and Y of the opposing conduits 28 and 30 are substantially parallel to the longitudinal axis Z of the body 14 for a purpose yet to be described.

The opposing conduits 28 and 30 intersect a lower transverse groove 32 formed in the closed end 22 of the body 14. The lower transverse groove 32 preferably is formed in the outside surface of the closed end 22 of the body 14, as shown in FIGS. 2 and 3, and communicates with the lateral opposing conduits 28 and 30 for a purpose yet to be described. Alternatively, and of course only when the conduits 28 and 30 are open grooves, the lower transverse groove 32 may comprise a tunnel in the interior surface of closed end 22 of the body 14.

Referring again to FIGS. 1 and 2, the cap 16 is receivable over the open end 20 of the body 14 to retain the explosive composition 24 inside the primer 10. The cap 16 is an integral one-piece unit formed by injection molding. A plastic material such as a linear low density polyethylene is preferred for the cap 16 since these types of plastics possess the physical characteristic of flexibility. The flexible cap 16 slides over the open end 20 of the body 14 and creates a seal against the body for retaining the explosive composition 24 in the primer 10. It will now be appreciated that the volume of explosive composition 24 in the body 14 approximates the volume of the body so that when the cap 16 is placed on the body, air in the body is forced to exit and the cap and the explosive composition interface.

Figure 4:
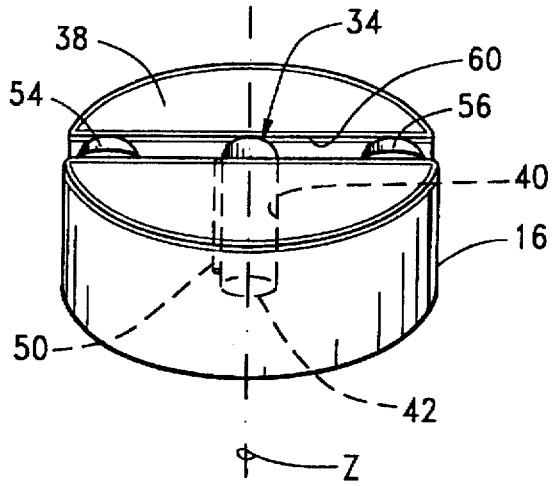
FIG. 4 is a perspective view of the cap of the primer of FIG. 1 and shows in phantom the structure of the tunnel.

An initiating device should be placed into contact with the explosive composition 24 inside the primer. As used herein, "initiating device" means the device which receives the charge from the fuse (as defined herein) and transmits the charge to the explosive composition 24, including without limitation blasting caps, electric and nonelectric detonators, and fuse caps. Proper placement of the initiating device within the primer is essential to ensure efficient detonation of the primer and, thus, the main charge. To that end, the cap 16 further comprises a port 34 as illustrated in FIGS. 1, 2 and 4. The port 34 serves as a point of entry into the container 12 so that an initiating device, such as detonator 36, may be placed in direct contact with the explosive composition 24 inside the container 12. The port 34 preferably is formed in the top side 38 of the cap 16.

Figure 5:
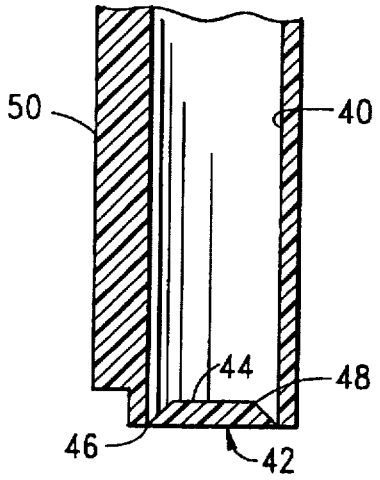
FIG. 5 is an enlarged, partial, cross-sectional view of the base of the tunnel of the invention of FIG. 1.

In the preferred embodiment, the port 34 defines a tunnel 40 and a base 42, illustrated in FIGS. 2, 4 and 5. The tunnel 40 is adapted to guidingly receive the detonator 36. The tunnel 40 preferably is an elongate cylinder and is open at the top side 38 of the cap 16. The tunnel 40 is coaxially aligned with the longitudinal axis Z of the body 14 for a purpose yet to be described and is sized to slideably receive the detonator 36. When the container 12 is assembled, the tunnel 40 depends from the cap 16 a distance into the body 14 of the container 12. The length of the tunnel 40 is less than the length of the detonator 36 for a purpose yet to be described.

Figure 6:
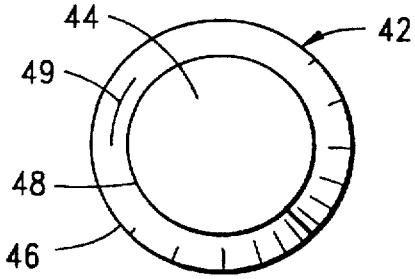
FIG. 6 is an enlarged plan view of the base of the tunnel of FIG. 1.

The base 42 of the port 34 is situated at the bottom of the tunnel 40 and is adapted to be pierced so that the detonator 36 may penetrate the cap 16 through the tunnel and be placed in direct contact with the explosive composition 24 in the container 12. In the preferred embodiment, illustrated in FIGS. 4 through 6, the base 42 preferably comprises a "punch out." The punchout comprises a circular center portion 44 surrounded by a weakened periphery 46. The weakened periphery 46 creates a bevel 48 with the center portion 44 of the base 42. The weakened periphery 46 adjacent the bevel 48 measures approximately 0.085 inches thick and gradually decreases in thickness, forming a membrane at the outermost point measuring approximately 0.007 to 0.009 inches thick. Thus, the base 42 in cross-section, resembles a frustum, as shown in FIG. 5.

The weakened periphery 46 offers less resistance to pressure than the center portion 44 of the base 42. When the detonator 36 is inserted into the tunnel 34, the weakened periphery yields at the point of pressure from the detonator 36, thereby permitting the detonator to be positioned in the explosive composition 24. Thus, the base 42 of the tunnel 40 is easily "punched out" by the application of gentle pressure, thereby allowing the detonator 36 to be inserted into the explosive composition 24 in the body 14. While it may be convenient to pierce the base 42 with the detonator 36, it will be appreciated that a punch or other approved device may be used to pierce the base, and the detonator may thereafter be inserted through the tunnel 40 into the explosive composition 24.

Figure 7:
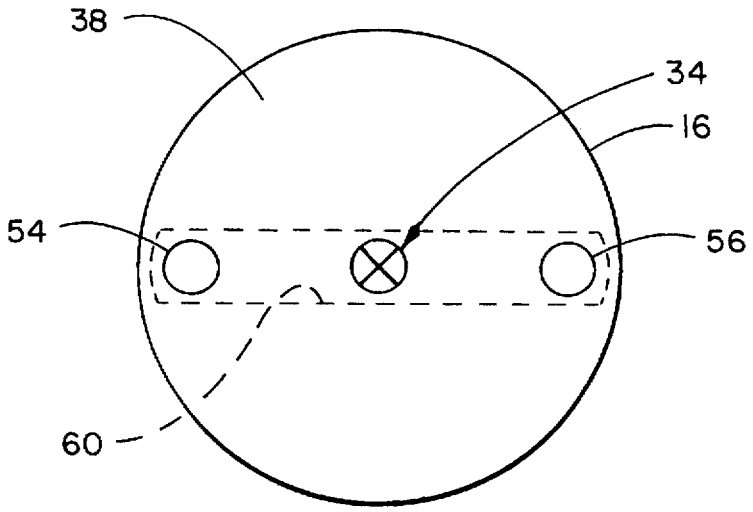
FIG. 7 is a plan view of the cap of the present invention illustrating an embodiment in which the base of the port is scored to permit the base to be pierced by the application of gentle pressure.

Other techniques may be available for making the base 42 pierceable. For example, the base 42 may comprise a scored membrane 49 to permit penetration of the detonator 38 into the explosive composition 24 in the body 14. Any alternative means, such as that illustrated in FIG. 7, permitting the initiating device 36 to penetrate the base 42 and to be positioned in the body 14 of the container 12 will suffice.

It will now be appreciated that the tunnel 40 is coaxially aligned with axis Z of the body 14 to guide the detonator 36 into a central position inside the container 12. It further will be appreciated that the length of the tunnel 40 is less than the length of the detonator to permit the detonator to make contact with the explosive composition 24 inside the container. Thus, the tunnel 40 and pierceable base 42 operate to ensure that the detonator is secure within the primer, makes contact with the explosive composition 24 and is positioned centrally within the primer. Proper positioning enhances uniform detonation, improves fragmentation and maximizes burning of the blasting agent.

With continuing reference to FIGS. 2, 4 and 5, cap 16 also preferably comprises a support structure 50 adapted to reinforce the structural integrity of the tunnel 40. In the preferred embodiment, the support structure 50 comprises a longitudinal rib integrally formed with the tunnel 40 and extending the length of the tunnel. The support structure 50 strengthens the tunnel 40 to withstand pressures received during penetration of the detonator 36 into the explosive composition 24 and while loading the primer 10 at the blasting site for detonation.

The cap 16 further comprises apertures 54 and 56 which are alignable with the opposing conduits 28 and 30 formed in the body 14, as illustrated in FIG. 2. When properly aligned, apertures 54 and 56 are continuous with conduits 28 and 30 for a purpose yet to be described. Additionally, the cap 16 comprises an upper transverse groove 60 which communicates with the apertures 54 and 56 and the port 34 in the cap for a purpose yet to be described.

In use, the assembled primer 10 will be suspended in a borehole from a fuse 62 connected to the detonator 36. As used herein, "fuse" means any device for transmitting charge to the initiating device including without limitation electric wire, nonelectric tubes and detonator cords. The type of fuse 62 selected depends upon the conditions and requirements at the blasting site. Detonator cords of not less than 25 grains per foot are preferred.

To suspend the primer 10 in a borehole, the fuse 62 is threaded through conduits 28 and 30 and correspondingly aligned apertures 54 and 56 formed respectively in the body 14 and the cap 16 of the primer 10. The fuse 62 may be threaded in various ways to permit selective positioning of the primer 10 in the borehole.

Referring again to FIG. 2, to suspend the assembled primer 10 with the cap 16 proximal the top of the borehole, the fuse 62, which is connected to the detonator 36, is first threaded through one of the apertures 54 or 56. For purposes of example, aperture 56 is selected. The fuse 62 is then threaded through the corresponding opposing conduit 30 with which the aperture 56 is aligned. The fuse 62 is then threaded through the lower transverse groove 32 and up through the remaining opposing conduit 28 and the aligned aperture 54. The fuse is then threaded through a portion of upper transverse groove 60 to the port 34. The detonator 36 at the end of the fuse 62 is inserted into the tunnel 40. By applying gentle pressure, the detonator 36 pierces the base 42 of the tunnel 40, thereby implanting the detonator directly in the explosive composition 24 near the center of the primer 10. Most, if not all, of the surface area of the detonator 36 should be in contact with the explosive composition 24. The primer 10 then may be suspended from the fuse 62 in the borehole with the cap 14 positioned proximal the top of the borehole.

To suspend the primer 10 with the cap 14 proximal the bottom of the borehole, the fuse 62 is threaded through one of the opposing conduits 28 or 30 from the closed end 22 of the body 14 and through the corresponding aligned aperture 54 or 56 in the cap 16. The fuse 62 is then threaded through a portion of the upper transverse groove 60 to the recess 36. The detonator 36 is pushed through the base 42 of the tunnel 40 as described above to embed the detonator in the explosive composition 24. The primer 10 then may be suspended in the borehole so that the cap 14 is positioned proximal the bottom of the borehole.

It will now be appreciated that the opposing conduits 28 and 30 and aligned apertures 54 and 56 receive and protect the fuse 62 on the inside of the primer 10, thus preventing crimping, abrasions and other damage. In addition, the generally parallel, opposing lateral positioning of the conduits 28 and 30 aids in selectively placing the primer 10 in a borehole. The upper and lower transverse grooves 32 and 60 are adapted to receive and protect the fuse 62 on the outside of the primer. The upper and lower transverse grooves 32 and 60 cooperate with the opposing conduits 28 and 30 and apertures 54 and 56 and the tunnel 40 to guide the fuse 62 to selectively position the primer 10 and secure the fuse in place without taping or tying the fuse to the primer.

Further, it will now be appreciated that the primer of the present invention aids in proper placement of the initiating device within the primer cartridge, secures the fuse cord to the primer so that it cannot be pulled off or out of the primer, minimizes damage to the fuse cord due to abrasions and pulls on the primer assembly, possesses adequate water resistance, and permits selective positioning of the primer at the blast site.

Changes may be made in the combination and arrangement of the various parts, elements, steps and procedures described herein without departing from the spirit and scope of the invention as defined in the following claims.

What is claimed is:

1. A container for containing an explosive composition and for use with an initiating device, the container comprising:

an enclosure for the explosive composition, the enclosure including a port;

wherein the port forms a base adapted to be pierced by the application of gentle pressure whereby the initiating device is insertable into the explosive composition inside the enclosure;

wherein the base comprises a center portion surrounded by a thin membrane adapted to yield to gentle pressure.

2. The container of claim 1 wherein the enclosure further comprises:

a body adapted to hold the explosive composition, the body having a closed end and an open end; and a cap receivable on the open end of the body, wherein the cap comprises the port.

3. The container of claim 2 wherein the cap and body each are integrally formed of molded plastic.

4. The container of claim 2 wherein a fuse is connectable to the initiating device and wherein:

the body further comprises at least two lateral, opposing conduits adapted to receive the fuse, the longitudinal axes of the conduits being generally parallel to the longitudinal axis of the body;

the closed end of the body further comprises a lower transverse conduit adapted to receive the fuse, the lower transverse conduit communicating with the lateral, opposing conduits;

the cap further comprises apertures alignable with the lateral opposing conduits of the body; and the cap further comprises an upper transverse conduit adapted to receive the fuse, the upper transverse conduit communicating with the apertures and the port in the cap.

5. The container of claim 1 wherein the port comprises a tunnel adapted to guidingly receive the initiating device, wherein the pierceable base is positioned near the bottom of the tunnel, and wherein the port centrally positions the initiating device inside the enclosure.

6. The container of claim 5 wherein the tunnel comprises an elongate cylinder extending a distance into the enclosure.

7. The container of claim 6 wherein the length of the tunnel is less than the length of the initiating device, thereby permitting the initiating device to be installed completely inside the enclosure.

8. The container of claim 5 wherein the tunnel is sized to slideably receive the initiating device.

9. The container of claim 1 wherein the center portion of the base defines a geometrical cross section.

10. The container of claim 9 wherein the geometrical cross section resembles a frustum.

11. The container of claim 1 wherein the thin membrane defines at least one score adapted to permit the base to be pierced by the application of gentle pressure.

12. An explosive primer for use with an initiating device the primer comprising:

an explosive composition, and an enclosure for the explosive composition, the enclosure including a port;

wherein the port forms a base adapted to be pierced by the application of gentle pressure, whereby the initiating device is insertable into the explosive composition inside the enclosure, wherein the base comprises center portion surrounded by a thin membrane adapted to yield to gentle pressure.

13. The primer of claim 12 wherein the enclosure further comprises:

a body adapted to hold the explosive composition, the body having a closed end and an open end; and a cap receivable on the open end of the body, wherein the cap defines the port.

14. The primer of claim 13 wherein the cap and body each are integrally formed of molded plastic.

15. The primer of claim 13 wherein a fuse is connectable to the initiating device and wherein:

the body further comprises at least two lateral, opposing conduits adapted to receive the fuse, the longitudinal axes of the conduits being generally parallel to the longitudinal axis of the body;

the closed end of the body further comprises a lower transverse conduit adapted to receive the fuse, the lower transverse conduit communicating with the lateral opposing conduits;

the cap further comprises apertures alignable with the lateral, opposing conduits of the body; and the cap further comprises an upper transverse conduit adapted to receive the fuse, the upper transverse conduit communicating with the apertures and the port in the cap.

16. The primer of claim 13 wherein the volume of explosive composition inside the body approximately equals the volume of the body, whereby when the container is assembled, the explosive composition interfaces with the cap and the initiating device installed in the body.

17. The primer of claim 12 wherein the port comprises a tunnel adapted to guidingly receive the initiating device, wherein the pierceable base is positioned near the bottom of the tunnel, and wherein the port centrally positions the initiating device inside the enclosure.

18. The primer of claim 17 wherein the tunnel comprises an elongate cylinder extending a distance into the enclosure.

19. The primer of claim 18 wherein the tunnel extends a distance into the enclosure and wherein the length of the tunnel is less than the length of the initiating device, thereby permitting the initiating device to be embedded completely in the explosive composition.

20. The primer of claim 17 wherein the tunnel is sized to slideably receive the initiating device.

21. The primer of claim 12 wherein the explosive composition is a water-based gel.

22. The primer of claim 12 wherein the center portion of the base defines a geometrical cross section.

23. The primer of claim 22 wherein the geometrical cross section resembles a frustum.

24. The primer of claim 12 wherein the thin membrane defines at least one score adapted to permit the base to be pierced by the application of gentle pressure.

25. A container for containing an explosive composition and for use with a fuse, the container comprising:

an enclosure for the explosive composition, the enclosure including:

a first end and a second end;

at least two lateral, opposing conduits adapted to receive the fuse, the longitudinal axes of the conduits being generally parallel to the longitudinal axis of the enclosure;

a lower transverse conduit formed in the second end, wherein the lower transverse conduit is adapted to receive the fuse and communicates with the lateral, opposing conduits; and an upper transverse conduit formed in the first end, wherein the upper transverse conduit is adapted to receive the fuse and communicates with the lateral, opposing conduits.

26. The container of claim 25 wherein the enclosure further comprises:

a body adapted to hold the explosive composition, the body defining:

a closed end and an open end;

the two lateral, opposing conduits; and the lower transverse conduit formed in the closed end; and a cap receivable on the open end of the body, wherein the cap further defines the upper transverse conduit and further defines two apertures alignable with the opposing, lateral conduits.

27. The container of claim 26 wherein an initiating device is connectable to the fuse and the cap further defines a port communicating with the upper transverse conduit, wherein the port is adapted to be pierced by the initiating device, whereby the initiating device is insertable into the explosive composition inside the body.

28. The container of claim 27 wherein the port defines a tunnel adapted to guidingly receive the initiating device and a pierceable base at the bottom of the tunnel, wherein the port centrally positions the initiating device inside the body.

29. The container of claim 28 wherein the tunnel comprises an elongate cylinder depending from the cap.

30. The container of claim 29 wherein the tunnel extends a distance into the explosive composition when the body is assembled with the cap and wherein the length of the tunnel is less than the length of the initiating device, thereby permitting the initiating device to be installed completely inside the enclosure.

31. The container of claim 28 wherein the tunnel is sized to slideably receive the initiating device.

32. The container of claim 28 wherein the pierceable base comprises a weakened periphery adapted to yield to pressure from the initiating device.

33. The container of claim 26 wherein the cap and body each are integrally formed of molded plastic.

34. An explosive primer for use with a fuse, the primer comprising:

an explosive composition;

an enclosure for the explosive composition, the enclosure including:

a first end and a second end;

at least two lateral, opposing conduits adapted to receive the fuse, the longitudinal axes of the conduits being generally parallel to the longitudinal axis of the enclosure;

a lower transverse conduit formed in the second end, wherein the lower transverse conduit is adapted to receive the fuse and communicates with the opposing, lateral conduits; and an upper transverse conduit formed in the first end, wherein the upper transverse conduit is adapted to receive the fuse and communicates with the opposing, lateral conduits.

35. The primer of claim 34 wherein the enclosure further comprises:

a body adapted to hold the explosive composition, the body defining:

a closed end and an open end;

the two lateral, opposing conduits; and the lower transverse conduit formed in the closed end; and a cap receivable on the open end of the body, wherein the cap defines the upper transverse conduit and further defines apertures alignable with the opposing lateral conduits.

36. The primer of claim 35 wherein an initiating device is connectable to the fuse and the cap further defines a port communicating with the upper transverse conduit and wherein the port is adapted to be pierced by an initiating device, whereby the initiating device is insertable into the explosive composition inside the body.

37. The primer of claim 36 wherein the port defines a tunnel adapted to guidingly receive the initiating device and a pierceable base at the bottom of the tunnel through which the initiating device is positioned centrally inside the body.

38. The primer of claim 37 wherein the tunnel comprises an elongate cylinder depending from the cap.

39. The primer of claim 38 wherein the tunnel extends a distance into the explosive composition when the body is assembled with the cap and wherein the length of the tunnel is less than the length of the initiating device, thereby permitting the initiating device to be completely embedded in the explosive composition.

40. The primer of claim 37 wherein the tunnel is sized to slideably receive the initiating device.

41. The primer of claim 37 wherein the pierceable base comprises a weakened periphery adapted to yield to pressure from the initiating device.

42. The primer of claim 35 wherein the cap and body each are integrally formed of molded plastic.

43. The primer of claim 35 wherein the volume of explosive composition inside the container approximately equals the volume of the body, whereby when the container is assembled, the explosive composition interfaces with the cap and the initiating device.

44. The primer of claim 34 wherein the explosive composition is a water-based gel.

45. A container for containing an explosive composition and for use with an initiating device, the container comprising:

an enclosure for the explosive composition, the enclosure including a port:

wherein the port forms a base adapted to be pierced by the application of gentle pressure whereby the initiating device is insertable into the explosive composition inside the enclosure, wherein the base defines at least one score adapted to permit the base to be pierced by the application of gentle pressure.

46. An explosive primer for use with an initiating device, the explosive primer comprising;

an explosive composition; and an enclosure for the explosive composition the enclosure including a port;

wherein the port forms a base adapted to be pierced by the application of gentle pressure whereby the initiating device is insertable into the explosive composition inside the enclosure, wherein the base defines at least one score adapted to permit the base to be pierced by the application of gentle pressure.

* * * * *